United States Patent [19]

Dell

[11] 4,106,755

[45] Aug. 15, 1978

[54] FLUIDIZED BED LADLE HEATING METHOD AND APPARATUS

[76] Inventor: William C. Dell, 1211 Conn. Ave., N.W., Washington, D.C. 20036

[21] Appl. No.: 809,363

[22] Filed: Jun. 23, 1977

Related U.S. Application Data

[63] Continuation-in-part of Ser. No. 799,238, May 23, 1977.

[51] Int. Cl.[2] ..... C21D 1/00

[52] U.S. Cl. ..... 266/44; 148/16; 148/20.3; 148/155; 164/121; 266/249; 266/287; 266/281

[58] Field of Search ..... 148/14, 16, 20.3, 155, 148/156; 164/121; 266/44, 172, 249, 251, 252, 257, 281, 287, 901

[56] References Cited

U.S. PATENT DOCUMENTS

| | | | |
|---|---|---|---|
| 3,666,253 | 5/1972 | Yoshio et al. | 148/14 |
| 3,930,786 | 1/1976 | Bloom | 266/901 |

*Primary Examiner*—Roy Lake
*Assistant Examiner*—Paul A. Bell
*Attorney, Agent, or Firm*—J. Gibson Semmes

[57] ABSTRACT

Method and apparatus for heating ladles of the type commonly used in the foundry and steel industry is described whereby fluidized bed technology is employed to achieve greatly improved fuel efficiency. In the method, the particles forming the substance of the bed are drawn directly into the ladle from a mother fluidized bed unit wherein a flow balancing is effected to establish a relatively steady state, simultaneously as the flow to various ladles under treatment may be changed. The invention is particularly adapted to the use of coal as a fuel.

14 Claims, 2 Drawing Figures

FIG. 1
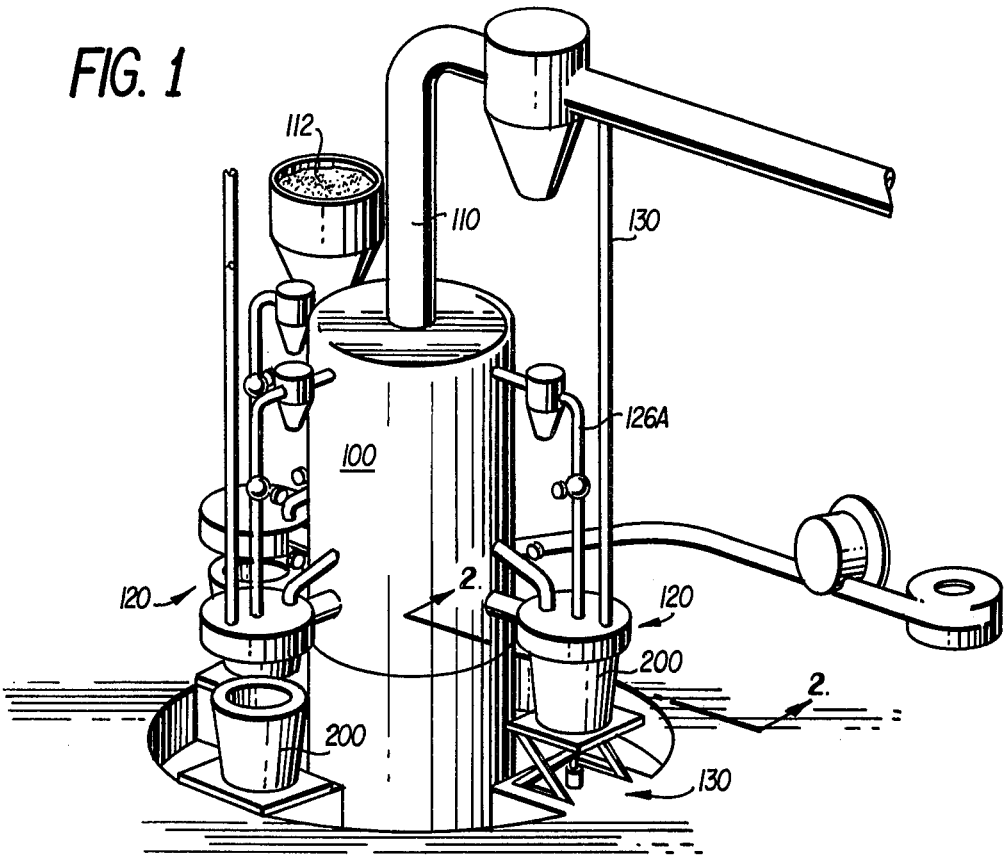
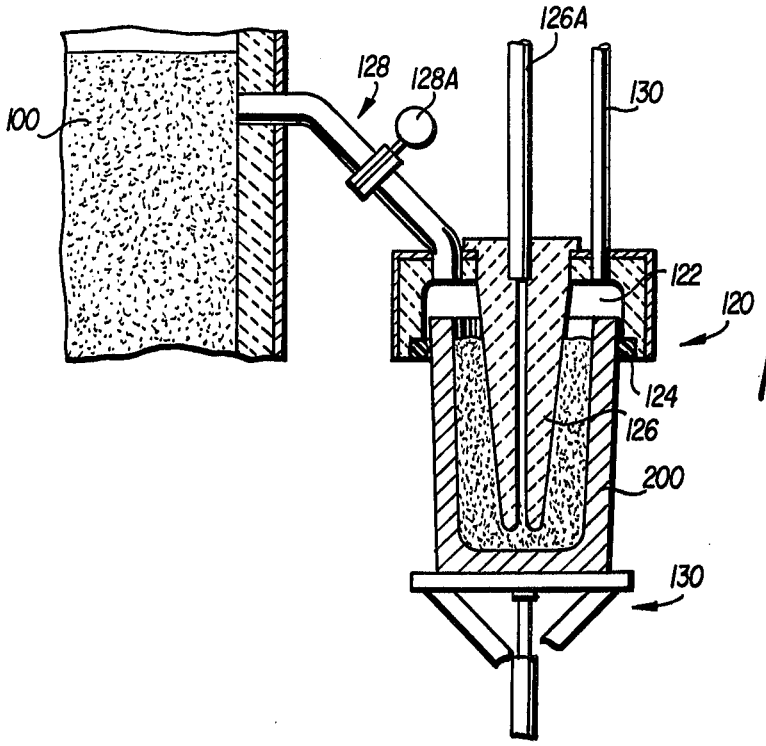
FIG. 2

FLUIDIZED BED LADLE HEATING METHOD AND APPARATUS

REFERENCE TO RELATED APPLICATION

This application is a continuation-in-part of application Ser. No. 799,238, filed May 23, 1977, entitled METHOD AND APPARATUS FOR HEAT TREATING OF METAL SHAPES OR CASTINGS.

BACKGROUND OF THE INVENTION

Among significant uses of fuel in the U.S. economy lie the operation of foundries and steel mills. In these operations, natural gas is customarily used for ladle drying and preheating, in addition to other tasks. Gas has been used primarily in these industries for the past two decades, because it has been low in cost and it has offered simplicity of operation, with minimum pollution control requirement. Nonetheless, drying and preheating of ladles is less than 10 percent efficient in the use of such high quality fuels. Due to the recent energy crisis and the decline in natural gas reserves in the U.S., It has become apparent that many of these industries will have to forego the use of gas for other fuels and employ more efficient processes.

The most plentiful alternative fuel in the United States today is coal. Coal comes in many varieties ranging from high volatile-high sulfur content to low volatile-low sulfur content coal all with a variety of ash content. Because of the nature of the fuel, several environmental problems may be encountered in applying it to foundries and steel mill operations. The principal problems are the gaseous emissions primarily found in the form of sulfur oxides and particulate emissions formed from the ash content of the coal.

The present invention is conceived to achieve minimum environmental impact, while allowing the use of coal and other fuels for several tasks in foundries and steel mills. The principal task herein comprises the preheating of ladles. These ladles are large steel bucket-like containers with refractory liners into which molten steel is poured, generally from electric arc or other type of furnaces. In order to minimize the cooling of the molten steel so that further pouring operations can be conducted, it is necessary to preheat the ladle to such temperature that little, if any, heat is lost from the molten steel into the ladle. As indicated above, the preheating operation is presently performed primarily with natural gas and it is thus proposed that this task be modified so that primarily a coal fuel and, secondarily, oil may be used.

Among gas fired ladle heaters are the Burnham blue flame industrial burner. It is currently used, for example in the preheating of ladles of the Shah-Milwaukee Steel Division, Grede's Foundries, Inc. In such instances, the pour ladle is disposed horizontally, relative to the industrial wall burner, an adapted refractory burner block having an appropriate hot gas return tube. Such gas fired ladle heaters operate at approximately 1800° F., although they may be operated at either high or low fire.

Ladle drying and preheating, and ladle-heating efficiency has also been made the subject of a group research proposal entitled Development of Lower-Cost Ladle-Heating Practices by the Battelle Columbus Laboratories as of Mar. 31, 1976; Proposal No. 926-8-3952. In none of the aforesaid has specific attention been given to adaptation of a fluidized mother bed, ladle heating system, utilizing apparatus and method of the type set forth in my co-pending application, Ser. No. 799,238, filed May 23, 1977, and entitled METHOD AND APPARATUS FOR HEAT-TREATING OF METAL SHAPES OR CASTINGS.

BRIEF DESCRIPTION OF THE DRAWING

FIG. 1 is a view in perspective of apparatus in accordance with the invention.

FIG. 2 is an enlarged sectional view, taken along lines 2—2 of FIG. 1, of ladle adapter interconnecting the ladle under treatment to the fluid bed furnace.

DESCRIPTION OF THE PREFERRED EMBODIMENTS

The present invention may be embodied in several modes, depending on the needs of a specific application, a preferred embodiment is shown in the accompanying drawings. This embodiment of the invention FIG. 1, includes a coal handling feed system 110, a "mother" or central fluid bed combustion furnace 100 with either external coal burners or injection of the coal, as for example, mixed with a sorbent, into the mother bed for burning as in conventional fluid beds, the furnace having multiple hot gas orifices and hot sand taps and ladle positioning devices, hereinafter described.

The furnace 100 having fuel and sorbent feed to the interior of its fluidized bed is also provided with a fluidizing air inlet and ash disposal beneath and out of the bed, each not shown. The furnace is provided with off-gas conductor 110, the same having an ash collector. Into the top of the furnace is disposed a hot sand return hopper 112. Whereas the system may include multiple ladle stations, disposed concentric of the furnace 100 and whereas said stations may be alternately large and small, the preferred arrangement 120 is shown with reference to FIGS. 1 and 2. Here, each ladle station 120 comprises a refractory lined cover 122, semi-fixed to the side of the furnace for convenience. Each refractory lined cover or lid has interiorly thereof, a high temperature inflatable seal, the function of which will be obvious from reference to FIG. 2. Here the ladle is shown in its raised position for functioning of the secondary fluidized bed ladle heating. The refractory cover 122 also carries a ceramic plug 126, said plug having a centrally disposed duct interconnecting with hot gas inlet 126A, said inlet having interconnection with the freeboard area of the furnace with suitable ash collection and valvular control. Also emanating from the refractory cover or lid 122 is the hot sand tap 128, said tap being located substantially adjacent the mother bed of the furnace 100 and having interposed between the mother bed interior of the furnace and the interior of the refractory lined cover 122, a gate valve 128A. A convenient elevator 130 is provided within the circular hip surrounding the furnace support whereby each ladle may be raised into position for heating and lowered from the semi-fixed cover and its ceramic plug, following heating.

In operation, the mother bed provides a combustion chamber and a holding facility for hot sand or other refractory particulate material which is to be tapped into ladles to form a secondary fluid bed by an accelerated heat transfer system. In operation, the fluid bed material from the mother bed, once fed into the ladle, is further fluidized with hot gases from the mother bed, providing excellent heat transfer into the ladle. When the ladle has then achieved a selected operating temperature, as for example 1500° - 2000° F., the hot sand is returned to the mother bed, thereby conserving the heat energy. Flows are balanced in the system by a series of simple gate valves or ceramic plugs, not shown but designed to constrict or increase the size of the duct 128 leading from the mother fluid bed to the ladle or from the fluid bed or the exhaust system. Sand or other bed material is thus drawn from the mother fluid bed into the correctly positioned ladle. The principal parts of the system comprise the mother fluidized bed unit burning coal or other suitable fuel, and a main exhaust for flow balancing, so that the fluid bed may be operated on a relatively steady state manner while the flow to the various ladles being heated may be changed. The refractory lined exhaust duct 126A withdraws gases from the top of the fluid bed container in the freeboard area so that little sand will be carried over, and whereby this gas is conducted into a ladle positioned around the nozzle or plug 126 at the base of the duct 126A. Ladles will be selectively brought into position by the hydraulic lift table 130 or by other suitable means so that each may fit inside the cover 122 which surrounds the downcomer for the hot gases and fluid bed. Part of each lid will comprise, as shown the duct and valve arrangement for withdrawing heated sand from the fluid bed and partially filling the ladle with this sand. See FIG. 2. If required, the flow rate of the gasses may then be increased by slightly lowering the ladle relative to the lid until the desired gas flow is achieved, and also by selectively manipulating the gate valve or plug constricting the flow through the downcomer. Each lid is refractory lined so as to contain the heat released inside the ladle and the ladle will be held in this manner until preheated to the limits of the system. Exhaust gasses from the system may be withdrawn through suitable orifices in the lid, as at 130, or allowed to leak around the top of the ladle and into the atmosphere of the structure in which the system is housed. In operation, it has been found that the sand in the ladle acts as a filtering media for the gasses. For burning high sulfur coals, an exhaust control system will be required in which case a duct with suitable ports would be installed on the lid to lead the used gasses to the emissions control system. If an anthracite or low sulfur coal is burned, no such system will be required; although it may be desirable for dust and particulate control. When the ladle is sufficiently heated or when a new ladle is to be placed over the nozzle, the air supply and fuel supply of the mother fluid bed may be temporarily shut off so that the ladle may be removed by lowering via the positioning table and a new ladle turned into position. The heated ladle will be picked up by a crane device and the hot sand therein dumped into a hot sand return hopper. When the new ladle is in place, the air and fuel supply for the mother fluid bed may be restarted. Nozzles and covers of several sizes will be constructed so that ladles of various sizes may be heated simultaneously.

Among the useful alternate advantages of the within method and apparatus is the concept of tapping the heated particles from the mother bed, as aforesaid, to simply heat soak a ladle up to a desired temperature.

I claim:

1. The method of high temperature heat treatment of foundry ladles comprising the steps of:

A. forming a mother fluidized bed of refractory particles capable of containing and sustaining high temperatures;

B. periodically entraining and firing a solid fuel within the mother fluidized bed to raise and sustain the temperature thereof to 1500° - 2000° F.; and C. sequentially conducting hot refractory particles and hot gasses from the mother fluidized bed to at least one ladle to form a secondary fluidized bed within said ladle raising the temperature of the ladle to the temperature range of the mother fluidized bed, while maintaining a steady state within both said beds.

2. The method according to claim 1, of high temperature heat treatment wherein the refractory particles of the mother bed comprise silicon dioxide sand.

3. The method according to claim 2, wherein the fuel comprises pulverized coal and a sorbent.

4. The method according to claim 3, further comprising simultaneously introducing into the mother bed pulverized limestone in sufficient quantity to effect a desulfurization of the coal.

5. The method according to claim 1 of high temperature treatment wherein the refractory particles of the bed comprise aluminum oxide.

6. The method according to claim 5, wherein the fuel comprises pulverized coal and a sorbent.

7. The method according to claim 6, further comprising simultaneously introducing into the mother bed limestone to effect desulfurization of the coal.

8. The method of high temperature treatment of metal objects of claim 1, wherein the fuel comprises pulverized coal and a sorbent.

9. The method according to claim 8 comprising simultaneously introducing into the mother bed with the coal and sorbent a sufficient quantity of pulverized limestone to effect desulfurization of the coal.

10. Apparatus for the heat treatment of foundry ladles comprising:

A. a furnace having combustion and freeboard zones;

B. means connected to the furnace for entraining pulverized solid fuel and a sorbent into the combustion zone of the furnace;

C. pneumatic means associated with the furnace forming within the combustion zone a mother fluidized bed of hot refractory particles and gasses of combustion;

D. at least one ladle station including a removable ladle and cover therefor, said cover and ladle having conduit connections with the combustion zone of the furnace and the freeboard zone thereof, whereby upon operation of the furnace the hot refractory particles and hot gasses of combustion of the mother bed may be selectively transferred to the ladle to form a secondary fluid bed therein, pending return to the mother bed.

11. Apparatus according to claim 10 wherein the said ladle station includes means for positioning the ladle relative to the cover.

12. Apparatus according to claim 10, further comprising plural ladle stations which are disposed in concentric relation to the furnace, wherein the conduit connections between the furnace include selective valvular control and wherein each said ladle station cover includes an off-gas outlet, whereby control of the gasses and refractory particles at inlet and off-gas outlet insures a fluidized bed steady state.

13. Apparatus according to claim 12 wherein the cover of said ladle station supports a ceramic plug, said plug forming a hot gas inlet nozzle and means contained by the cover to seal the ladle and cover together.

14. Apparatus according to claim 10, wherein the cover of said ladle station supports a ceramic plug, said plug forming a hot gas inlet nozzle and means contained by the cover to seal the ladle and cover together.

* * * * *